US010933666B2

(12) United States Patent
Vaillancourt et al.

(10) Patent No.: US 10,933,666 B2
(45) Date of Patent: Mar. 2, 2021

(54) PRINTER BAND EDGE HOLD DOWN SYSTEMS

(71) Applicant: Electronics for Imaging, Inc., Fremont, CA (US)

(72) Inventors: Keith Vaillancourt, Hudson, NH (US); Christopher Andrew Porter, Weare, NH (US)

(73) Assignee: ELECTRONICS FOR IMAGING, INC., Fremont, CA (US)

( * ) Notice: Subject to any disclaimer, the term of this patent is extended or adjusted under 35 U.S.C. 154(b) by 0 days.

(21) Appl. No.: 16/387,828

(22) Filed: Apr. 18, 2019

(65) Prior Publication Data

US 2019/0240999 A1 Aug. 8, 2019

Related U.S. Application Data

(62) Division of application No. 15/491,831, filed on Apr. 19, 2017, now Pat. No. 10,265,978.

(60) Provisional application No. 62/341,276, filed on May 25, 2016.

(51) Int. Cl.

| | |
|---|---|
| ***B41J 11/00*** | (2006.01) |
| ***B41J 3/28*** | (2006.01) |
| ***B41J 13/00*** | (2006.01) |
| ***B41J 15/16*** | (2006.01) |

(52) U.S. Cl.

CPC ..... *B41J 15/16* (2013.01); *B41J 3/28* (2013.01); *B41J 11/007* (2013.01); *B41J 11/0045* (2013.01); *B41J 13/0072* (2013.01); *B41J 11/0085* (2013.01)

(58) Field of Classification Search

CPC ..... B41J 11/0045; B41J 11/007; B41J 3/28; B41J 13/0072

See application file for complete search history.

(56) References Cited

U.S. PATENT DOCUMENTS

| | | | | |
|---|---|---|---|---|
| 3,215,255 | A | 11/1965 | Carter | |
| 4,900,172 | A * | 2/1990 | Svoboda | B41J 11/58 400/605 |
| 4,942,426 | A | 7/1990 | Jones et al. | |
| 2005/0264467 | A1* | 12/2005 | Lin | H01Q 1/125 343/882 |

(Continued)

FOREIGN PATENT DOCUMENTS

| | | |
|---|---|---|
| EP | 2918418 A2 | 9/2015 |
| EP | 2985250 A1 | 2/2016 |

*Primary Examiner* — Jason S Uhlenhake

(74) *Attorney, Agent, or Firm* — Perkins Coie LLP

(57) ABSTRACT

Edge hold down (EHD) systems are described herein that enable high print quality to be achieved more consistently, particularly when using substrates that are rigid or include one or more defects. Each EHD system includes a tensioned band for holding down an edge of a substrate as it passes through a printer assembly without impacting the print area. The tensioned band can be affixed between an entry tension assembly and an exit tension assembly disposed downstream of the entry tension assembly in the media feed direction. The tensioned band holds the substrate substantially flat against a transfer belt during printing by applying pressure to the surface of the substrate. The tensioned band generally contacts the surface of the substrate substantially proximate to an outer edge that is parallel to the media feed direction.

13 Claims, 17 Drawing Sheets

(56) References Cited

U.S. PATENT DOCUMENTS

| | | | | |
|---|---|---|---|---|
| 2010/0209169 | A1* | 8/2010 | Mandel | B41J 11/005 400/619 |
| 2013/0136521 | A1 | 5/2013 | Garcia et al. | |
| 2016/0039626 | A1 | 2/2016 | Snir | |
| 2017/0341435 | A1 | 11/2017 | Vaillancourt et al. | |

* cited by examiner

PRINTER BAND EDGE HOLD DOWN SYSTEMS

CROSS-REFERENCE TO RELATED APPLICATIONS

This application is a divisional of U.S. application Ser. No. 15/491,831, titled "Printer Band Edge Hold Down Systems" and filed on Apr. 19, 2017, now U.S. Pat. No. 10,265,978, which claims priority to and the benefit of U.S. Provisional Application No. 62/341,276, titled "Printer Band Edge Hold Down" and filed on May 25, 2016, each of which are incorporated by reference herein in their entirety.

RELATED FIELD

Various embodiments relate to structures for improving the print quality of printer assemblies. More specifically, various embodiments concern mechanisms for holding a substrate against a transfer belt that passes through a printer assembly.

BACKGROUND

Inkjet printing is a type of computer printing that recreates a digital image by depositing droplets of ink onto a substrate, such as paper or plastic. Many contemporary inkjet printers utilize drop-on-demand (DOD) technology to force droplets of ink from a reservoir through a nozzle onto the substrate. Accordingly, the mounting and positioning of the reservoir and nozzle (among other components) with respect to the surface of the substrate is critical to accurately depositing drops of ink in the desired position. Together, these components form a print head (also referred to as a "print head assembly").

Inkjet printers must position individual droplets of ink with high accuracy and precision in order to output images of acceptable quality. There are several possible sources of error that can contribute to inaccurate and/or imprecise droplet positioning. For example, one key factor is ensuring the substrate maintains a static position as a transfer belt (also referred to as a "conveyor") passes the substrate through the printer.

Conventional flatbed printers allow the substrate to simply sit on the transfer belt after being positioned by an individual or a machine. However, sufficient accuracy and precision can be difficult to achieve using a conventional flatbed printer, particularly if the substrate moves as it passes through the conventional flatbed printer. Even small changes in the location of the substrate results in inconsistent placement of droplets of ink (i.e., low droplet accuracy) and poor print quality. Movement may be due, for example, to small defects in the substrate that cannot be easily flattened.

SUMMARY

Techniques for more consistently ensuring high print quality are described herein. More specifically, edge hold down (EHD) systems are described herein that include a tensioned band for holding down an edge of a substrate as it passes through a printer assembly without impacting the print area. The tensioned band can be affixed between an entry tension assembly and an exit tension assembly disposed downstream of the entry tension assembly in the media feed direction. The tensioned band holds the substrate substantially flat against a transfer belt during printing by applying pressure to the surface of the substrate. The tensioned band generally contacts the surface of the substrate substantially proximate to an outer edge that is parallel to the media feed direction.

The tensioned band may be difficult to distort due to its stiffness. For example, the tensioned band may comprise spring steel formed into a thin, narrow strip. Tensioned bands having high stiffness are typically sufficient to hold the substrate substantially flat against the transfer belt. However, in some embodiments, a vacuum belt assembly may be necessary because the tensioned band creates too much friction, which causes the substrate to slip on the transfer belt. Whether a vacuum belt assembly is required in addition to the tensioned band(s) depends on characteristics of the substrate being printed on (e.g., the surface friction).

A printer assembly may include one or more EHD systems. For example, a printer assembly configured for one-up printing may include two EHD systems (and thus two tensioned bands), while a printer assembly configured for two-up printing may include four EHD systems (i.e., a separate set of tensioned bands for each of two substrates that have been placed on the transport belt).

BRIEF DESCRIPTION OF THE DRAWINGS

One or more embodiments of the present disclosure are illustrated by way of example and not limitation in the figures of the accompanying drawings, in which like references indicate similar elements.

DETAILED DESCRIPTION

Figure 1:
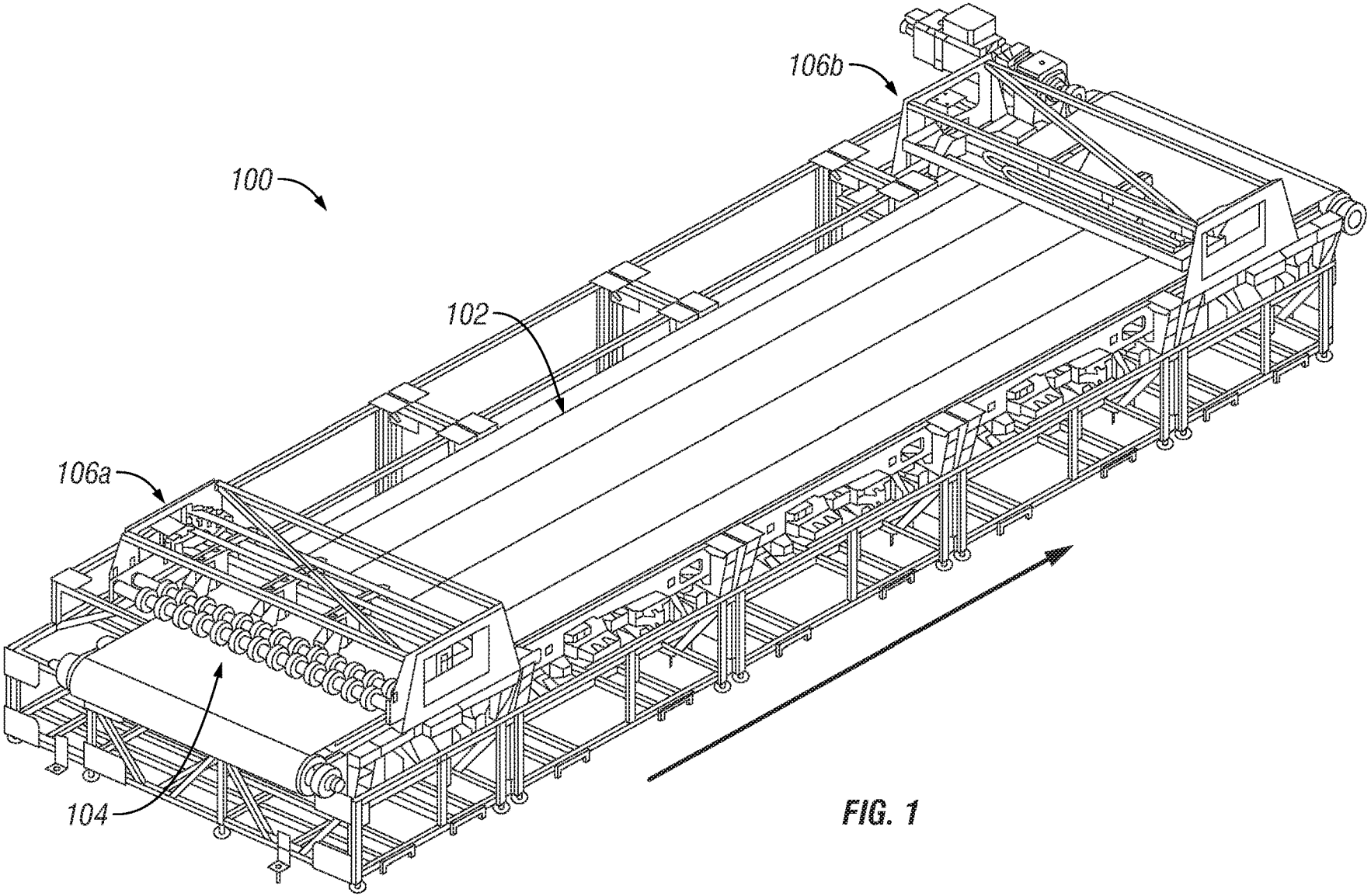
FIG. 1 depicts a printer assembly that includes a transport belt onto which substrates are placed for printing.

Maintaining a consistent position of a substrate (also referred to as "print media") as it passes through a printer is critical to ensuring high print quality. The substrate is often comprised of a rigid material, such as cardboard. Conventional printers may include a vacuum belt assembly that is configured to draw the substrate onto an upper surface of a transfer belt moving in a media feed direction.

When a rigid substrate is substantially flat, then the vacuum belt assembly can draw the rigid substrate against the surface of the transfer belt without significant issues. However, if the rigid substrate includes one or more defects (e.g., a curl or a notch), the vacuum belt assembly may be unable to draw the rigid substrate against the surface of the transfer belt due to its rigidity. For example, small defects along the outer edge of the rigid substrate may cause the vacuum(s) of the vacuum belt assembly to experience too much leakage.

One possible solution is to use more effective, higher-grade vacuum(s). However, this approach generally isn't feasible for many printers due to cost constraints and/or space constrains (e.g., limited space within a printer housing). Another solution is to mechanically apply pressure to one or more edges of the substrate, which typically enables the vacuum belt assembly to work as intended.

Disclosed herein, therefore, are edge hold down (EHD) systems for holding down one or more edges of a substrate without impacting the print area. More specifically, a tensioned band can be affixed between an entry tension assembly and an exit tension assembly. The tensioned band holds the substrate substantially flat against a transfer belt during printing by applying pressure to the surface of the substrate. The tensioned band generally contacts the surface of the substrate substantially proximate to an outer edge that is parallel to the media feed direction.

The tensioned band may be difficult to distort due to its stiffness. For example, the tensioned band may comprise spring steel formed into a thin, narrow strip. Tensioned bands having high stiffness are typically sufficient to hold the substrate substantially flat against the transfer belt. However, in some embodiments, a vacuum belt assembly may be necessary because the tensioned band creates too much friction, which causes the substrate to slip on the transfer belt. Whether a vacuum belt assembly is required in addition to the tensioned band(s) depends on characteristics of the substrate being printed on (e.g., the surface friction).

The EHD systems described herein are primarily intended for use with inkjet printers (e.g., single-pass printing systems or multiple-pass printing systems), though one skilled in the art will recognize many of the embodiments may be used with other types of printers. Similarly, many of the figures illustrate wide format (i.e., large format) printers, though other formats could also be used, including narrow format printers and superwide format (i.e., grand format) printers.

Terminology

Brief definitions of term, abbreviations, and phrases used throughout the application are given below.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments necessarily mutually exclusive of other embodiments. Moreover, various features are described that may be exhibited by some embodiments and not by others. Similarly, various requirements are described that may be requirements for some embodiments and not for other embodiments.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of or connection between the elements can be physical, logical, or a combination thereof. For example, two components may be coupled directly to one another or via one or more intermediary channels or components. As another example, devices may be coupled in such a way that the devices do not share a physical connection with one another.

Additionally, the words "herein," "above," "below," and words of similar import, when used in this application, shall refer to this application as a whole and not to any particular portions of this application. Where the context permits, words in the Detailed Description using the singular or plural number may also include the plural or singular number respectively. The word "or," in reference to a list of two or more items, covers all of the following interpretations of the word: any of the items in the list, all of the items in the list, and any combination of the items in the list.

If the specification states a component or feature "may," "can," "could," or "might" be included or have a characteristic, that particular component or feature is not required to be included or have the characteristic.

The terminology used in the Detailed Description is intended to be interpreted in its broadest reasonable manner, even though it is being used in conjunction with certain examples. The terms used in this specification generally have their ordinary meanings in the art, within the context of the disclosure, and in the specific context where each term is used. For convenience, certain terms may be highlighted, for example using capitalization, italics, and/or quotation marks. The use of highlighting has no influence on the scope and meaning of a term; the scope and meaning of a term is the same, in the same context, whether or not it is highlighted. It will be appreciated that an element or feature can be described in more than one way.

Consequently, alternative language and synonyms may be used for any one or more of the terms discussed herein, and special significance is not to be placed on whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only, and is not intended to further limit the scope and meaning of the disclosure or of any exemplified term. Likewise, the disclosure is not limited to the various embodiments given in this specification.

System Overview

FIG. 1 depicts a printer assembly 100 that includes a transport belt 102 onto which substrates are placed for printing. The transport belt 102 typically travels beneath a series of rollers 104 and then one or more print heads (not shown) that are disposed downstream of the rollers 104 in the media feed direction. Embodiments may include various combination of these and other components (e.g., curing assemblies such as dryers or radiation sources). While the printer assembly 100 of FIG. 1 includes a transport belt 102, other means for conveying and/or retaining a substrate can also be used, such as a rotating platform or stationary bed. Moreover, in some embodiments the transport belt 102 include one or more vacuum chambers that attempt to pull the lower surface of the substrate against the transport belt 102 (also referred to as a "vacuum belt" or "vacuum table" in such embodiments).

The print head(s) can recreate digital images by depositing droplets of ink onto a substrate (i.e., a base material onto which images are printed), such as plastic films, textiles, paper (e.g., lightweight stock, heavyweight stock, paperboard, cardboard), parchment, etc. In some embodiments, the printer head(s) include inkjet printer heads that jet ink onto the substrate using, for example, piezoelectric nozzles.

As shown in FIG. 1, one or more edge hold down (EHD) assemblies may also be disposed above the transport belt 102. Each EHD assembly includes an entry tension assembly 106*a* and an exit tension assembly 106*b* that is disposed downstream of the entry tension assembly 106*a* in the media feed direction. Each EHD assembly also includes a tensioned band that extends from the entry tension assembly 106*a* to the exit tension assembly 106*b*. The tensioned band(s) within the printer assembly 100 can hold a substrate substantially flat against the transport belt 102 during printing by applying pressure to the surface of the surface.

The substrate will often be longitudinal in nature (e.g., a square, rectangle, or some other trapezoidal shape) having at least one substantially straight edge onto which one or more tensioned bands apply pressure, though substrates of various shapes and sizes may be used for printing. In such embodiments (i.e., where the substrate is non-rectangular in nature), the tensioned band(s) may not extend along the outer periphery of the shape. Note, however, that the tensioned band(s) still cannot overlap a print region regardless of the shape of the substrate.

Figure 2:
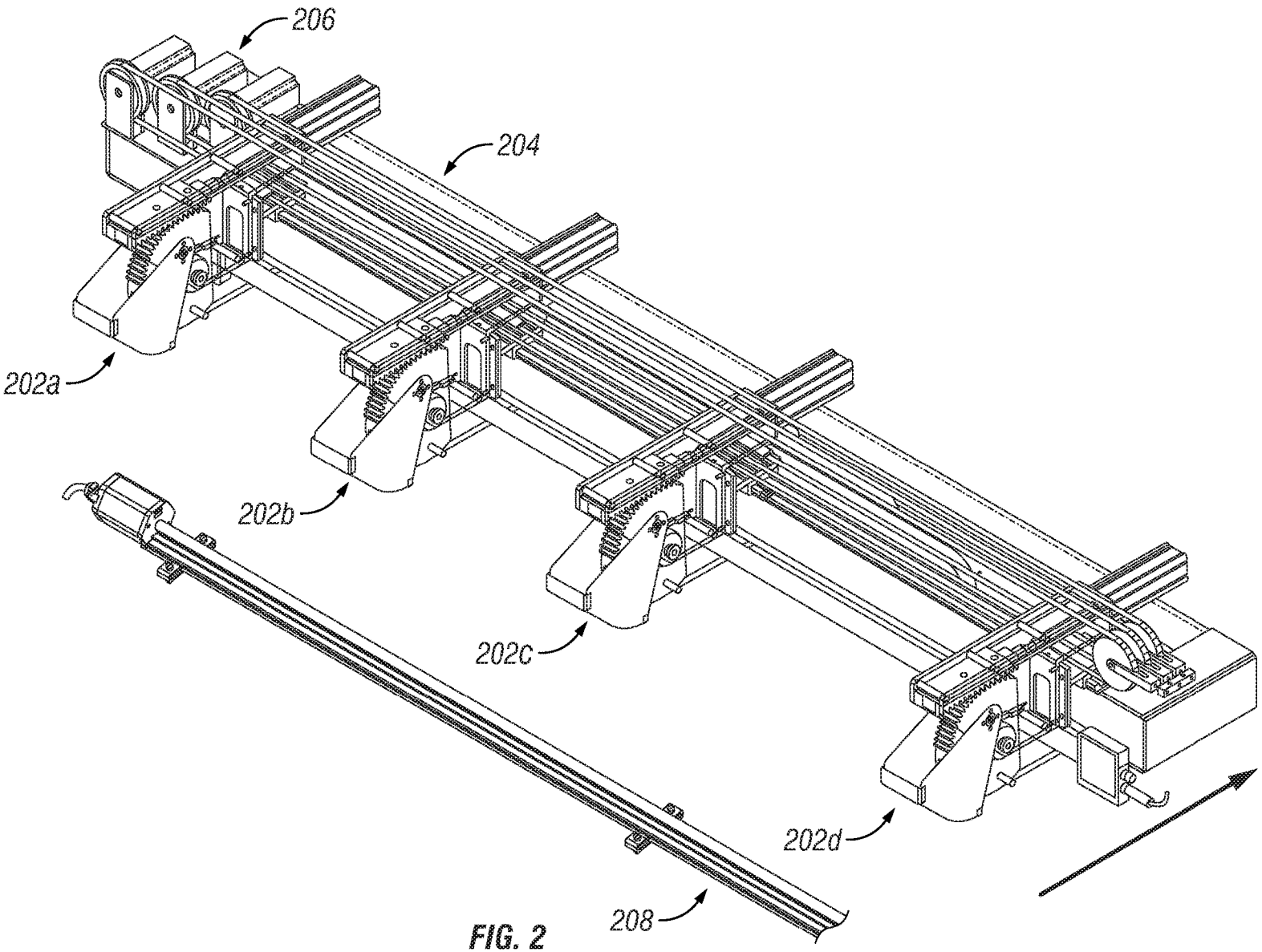
FIG. 2 depicts one example arrangement of four entry tension assemblies that are fixedly attached to a rigid feature of a printer assembly.

FIG. 2 depicts one example arrangement of four entry tension assemblies 202*a-d* that are fixedly attached to a rigid feature 204 of a printer assembly. The rigid feature 204 may be, for example, a bar or a support beam that extends across a transfer belt and/or a bed of the printer assembly. The printer assembly also includes one or more print heads that are disposed downstream of the entry tension assemblies 202*a-d* in the media feed direction. Accordingly, once a substrate is placed onto a transport belt, the substrate travels beneath the entry tension assemblies 202*a-d* before it is exposed to the print head(s).

More specifically, FIG. 2 depicts a fully automatic design that allows tensioned bands (also referred to as "edge guides") to be moved by one or more horizontal adjustment drives 206 based on the width of the substrate that is to be printed on. Each horizontal adjustment drive 206 can include a motor, timing belt, one or more pulleys, etc. For example, if the printer assembly includes a bed that is 2 meters wide and the substrate is 1.2 meters wide, then two entry assemblies (e.g., entry assemblies 202*a-b*) can be disposed along the rigid feature so that they are substantially 1.2 meters wide.

In some embodiments, a sensor, transducer, or readhead that determines the width of the substrate is disposed upstream of the entry tension assemblies 202*a-d* in the media feed direction. For example, a linear encoder 208 may determine the width of the substrate, convert the encoded width into an analog or digital signal, and then transmit the analog or digital signal to a motion controller that controls the horizontal adjustment drives 206.

A subset of the entry tension assemblies 202*a-d* may be fixed in a particular position. Here, for example, the three outermost entry assemblies (i.e., entry tension assemblies 202*a-c*) may be allowed to move along a belt, while the innermost tension assembly (i.e., entry tension assembly 202*d*) remains in a fixed position. Horizontal adjustment of the entry tension assemblies 202*a-d* can be performed manually by a user or automatically by the printer assembly. For example, the printer assembly may be configured to automatically move one or more of the entry tension assemblies 202*a-d* upon receiving input from the individual indicative of the width of the substrate to be printed on. Such input could be provided via a user interface that is presented by the printer assembly or an electronic device (e.g., mobile phone, tablet, or laptop) that is communicatively coupled to the printer assembly.

One skilled in the art will recognize that substrates also come in varying thicknesses. Accordingly, FIG. 2 illustrates that the printer assembly may also include a vertical adjustment drive that allows the vertical position of the entry tension assemblies 202*a-d* to be modified based on the thickness of the substrate that is to be printed on. The vertical adjustment drive can include a motor, one or more screws, one or more sliding rails, etc. For example, if the substrate is 4 millimeters (mm) thick, then the entry tension assemblies 202*a-d* should be set off the bed of the printer assembly by approximately 4 mm. The tensioned band of each EHD system should preferably apply pressure to the surface of the substrate without distorting the substrate.

The vertical position of the entry tension assemblies 202*a-d* (and thus the tensioned bands) could be adjusted manually or automatically. For example, the vertical position could be manually adjusted by a user (e.g., by turning a knob that adjusts a screw jack) after determining the thickness of the media. As another example, the vertical position could be automatically adjusted by the printer assembly using one or more motors after detecting the thickness of a substrate being loaded onto a transport belt or receiving input from the user specifying the thickness of the substrate. Thus, both vertical and horizontal placement of each entry tension assembly is often job-specific.

Figure 3:
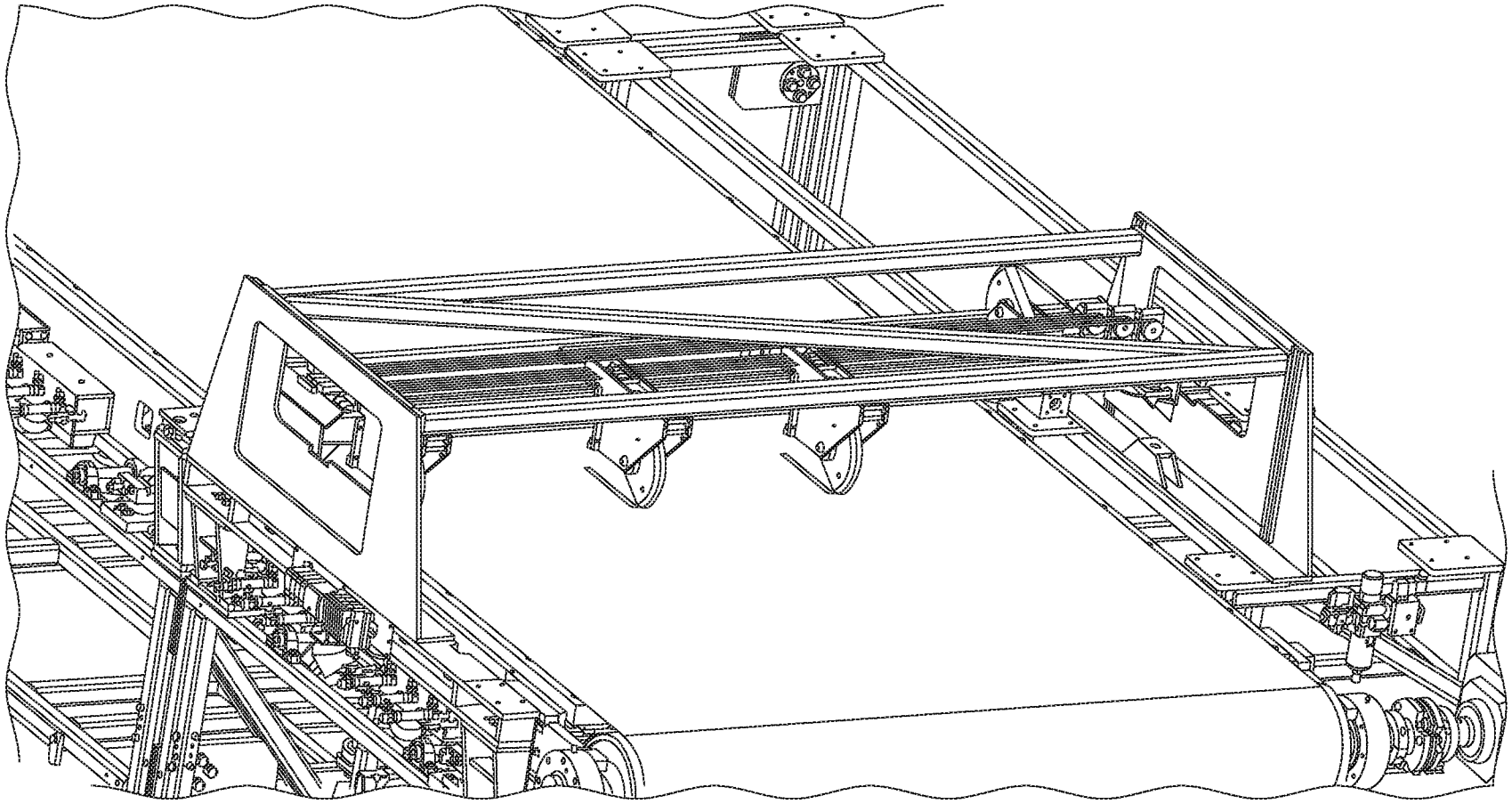
FIG. 3 depicts one example arrangement of four exit tension assemblies that are fixedly attached to another rigid feature of a printer assembly.

FIG. 3 depicts one example arrangement of four exit tension assemblies that are fixedly attached to another rigid feature of a printer assembly. The exit tension assemblies often represent a simplified version of the entry tension assemblies (e.g., entry tension assemblies 202*a-d* of FIG. 2). For example, rollers may not precede the exit tension assemblies, though the horizontal and vertical movement of the exit tension assemblies may be controlled in the same manner (i.e., using one or more horizontal adjustment drives and a vertical adjustment drive).

As shown in FIG. 3, one end of each tensioned band is connected to an entry tension assembly while the opposite end of each tensioned band is connected to an exit tension assembly. Because the substrate resides on the transport belt beneath the tensioned bands, the embodiments described herein enable more accurate imaging and provide some security that no substrate defects that will cause damage to a print head.

Figure 4A:
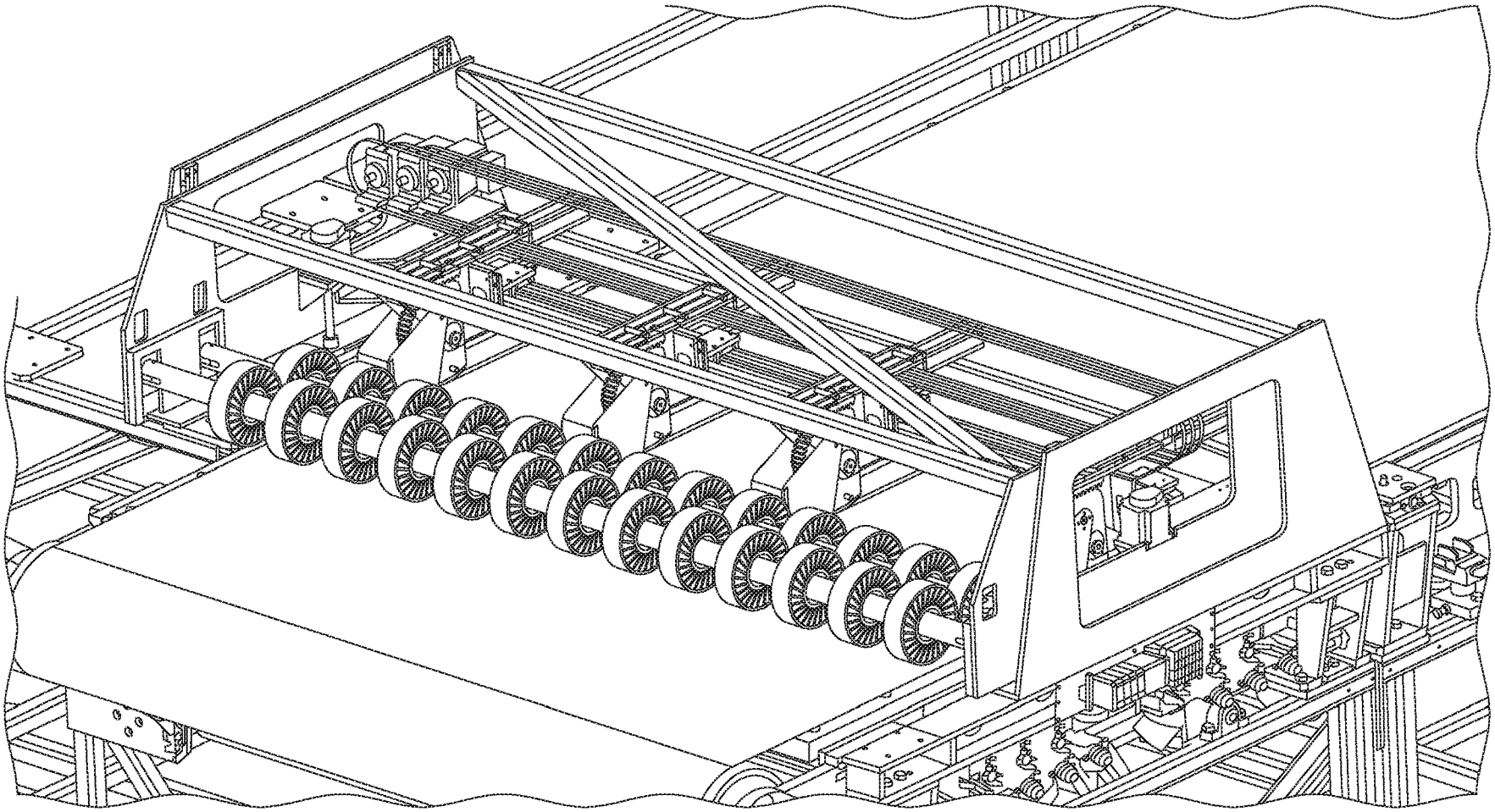
FIG. 4A depicts how rollers and multiple entry tension assemblies can be housed within a frame.

FIG. 4A depicts how rollers and multiple entry tension assemblies can be housed within a frame. In some embodiments, the frame is guided by linear bearings that are bolted to a fixed frame that is fixedly mounted to a printer assembly. Movement of the frame may be effected by stepper motors that are responsible for actuating the frame. The frame and/or the fixed frame may be partially or entirely uncovered, thereby allowing a user to readily service the entry tension assemblies and/or replace the tensioned bands.

Figure 4B:
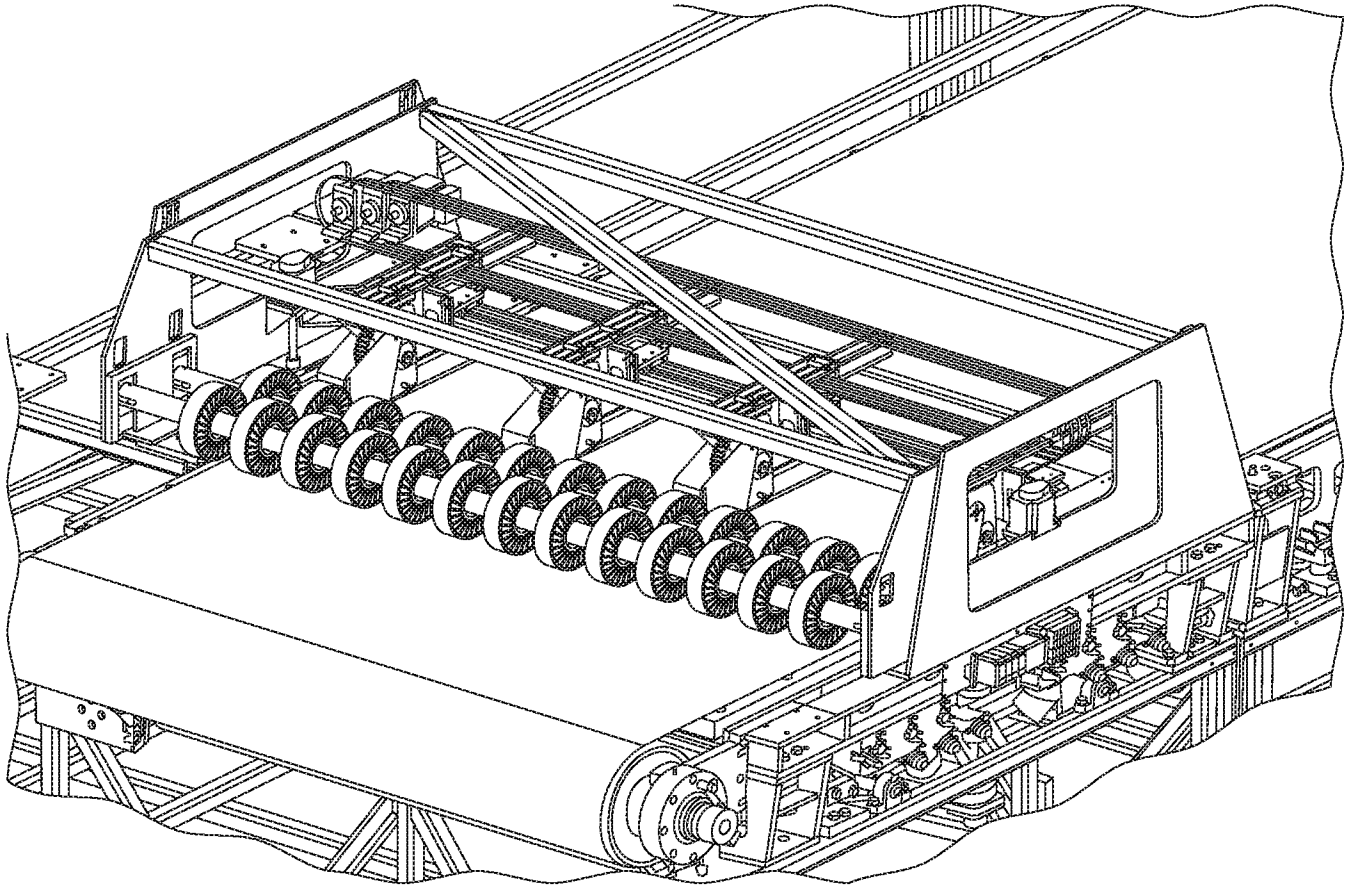
FIG. 4B depicts how the frame and the fixed frame allow the entry tension assemblies to be moved to a specified position with respect to the entrance of the transport belt.

FIG. 4B, meanwhile, depicts how the frame and the fixed frame allow the entry tension assemblies to be moved to a specified position with respect to the entrance of the transport belt. Here, for example, the distance from the first set of rollers to the entrance of the transport belt (e.g., the first vacuum tube of a vacuum belt) is 400 mm. Thus, entry tension assemblies can be adjusted along the x-axis (i.e., horizontally orthogonal to the media feed direction), y-axis (i.e., vertically orthogonal to the media feed direction), and/or z-axis (i.e., longitudinally parallel to the media feed direction).

Figure 5A:
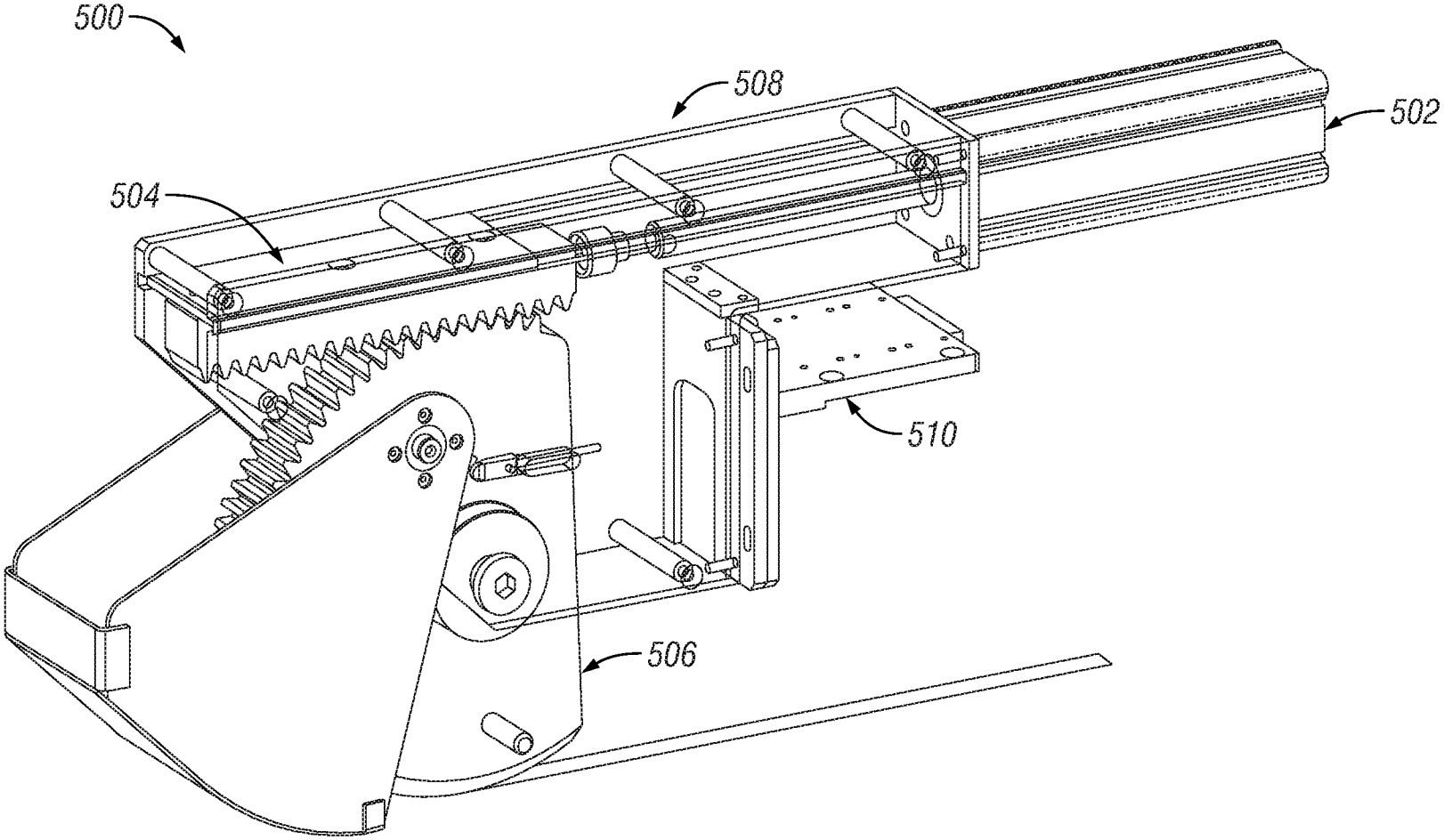
FIG. 5A illustrates one example embodiment of an entry tension assembly.

FIG. 5A illustrates one example embodiment of an entry tension assembly 500. The entry tension assembly 500 can include a pneumatic cylinder 502 connected to a rack 504 and a pivot gear 506 that engages the rack 504. The rack 504 may be mounted (e.g., using one or more bolts) to a slide plate that is disposed within a track that guides linear motion of the rack 504. In some embodiments, the pneumatic cylinder 502 is connected to the rack 504 via a floating joint that allows misalignment between the pneumatic cylinder 502 and the rack 504.

The pneumatic cylinder 502, the rack 504, and the pivot gear 506 may at least partially reside within a housing 508 that is securely mounted to a rigid feature of a printer assembly. For example, the housing 508 may be mounted to a frame that extends across the bed of the printer assembly using a mount bracket 510, screws, etc.

The pivot gear 506 (i.e., the "pinion") includes teeth that engage complementary teeth on the rack 504. Linear motion applied to the rack 504 by the pneumatic cylinder 502 causes the rack 504 to move relative to the pivot gear 506, thereby converting linear motion of the rack 504 into rotational motion of the pivot gear 506.

Figure 5B:
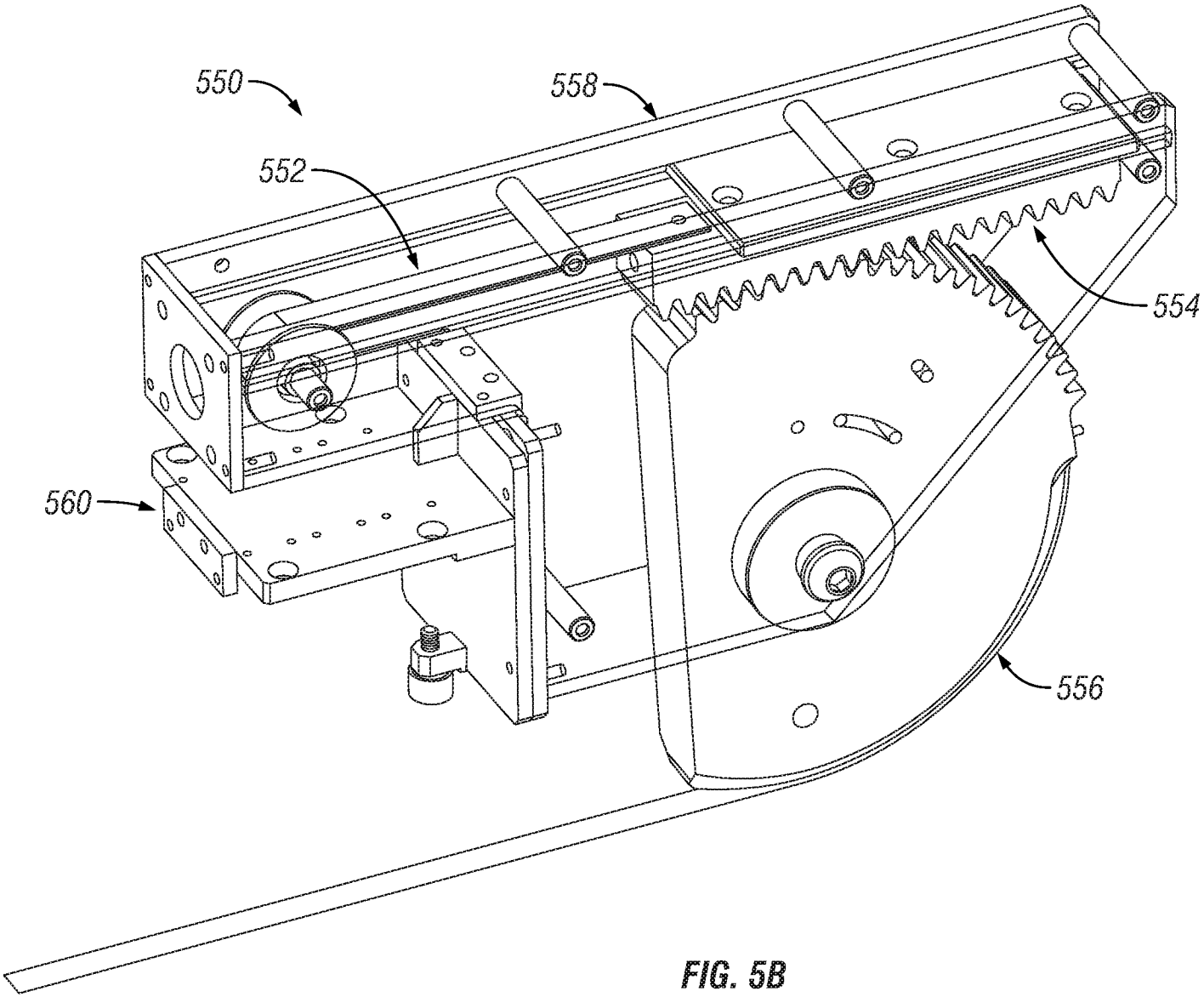
FIG. 5B illustrates one example embodiment of an exit tension assembly.

FIG. 5B illustrates one example embodiment of an exit tension assembly 550. The exit tension assembly 550 may also include a rack 554 that engages a pivot gear 556. However, the exit tension assembly 550 may use a spring 552 that provides a constant force rather than a pneumatic cylinder. The spring 552 causes the rack 554 to naturally retract when no tension is applied to the pivot gear 506 by a tensioned band.

The rack 554 and the pivot gear 556 may at least partially reside within a housing 558 that is securely mounted to another rigid feature of the printer assembly. For example, the housing 558 may be mounted to a support beam that extends across the bed of the printer assembly using a mount bracket 560, screws, etc.

As shown in FIG. 1, one or more EHD systems may be disposed above a transport belt of a printer assembly. Each EHD system includes an entry tension assembly 500 and an exit tension assembly 550 that is disposed downstream of the entry tension assembly 500 in the media feed direction. One end of a tensioned band is connected to the pivot gear 506 of the entry tension assembly 500, while the opposite end of the tensioned band is connected to the pivot gear 556 of the exit tension assembly 550.

Therefore, each EHD system includes a single tensioned band that holds a substrate substantially flat against the transport belt during printing by applying pressure to the surface of the substrate. The tension level of the tensioned band may be held substantially constant by the pneumatic cylinder 502 of the entry tension assembly 500 during printing. In some embodiments, the tensioned band is a narrow, thin, spring steel strip that traverses the entire print zone to hold down an edge of the substrate against the transfer belt, thereby enabling more accurate printing across the full printable width of the substrate.

The tensioned band may be designed based on the tension level expected during printing or other characteristics of the printing process (e.g., heat or humidity level within an enclosure). For example, the tensioned band may be designed by placing approximately 100 pounds into a high-strength band that provides a specific tension value. As noted above, the entry tension assembly 500 and/or the exit tension assembly 550 may also be designed to facilitate servicing and/or replacing of the tensioned band. For example, in order to remove the tensioned band from the entry tension assembly 500, a user may simply need to release the air from the pneumatic cylinder 502 and detach the tensioned band from the pivot gear 506. The tensioned band can then be cleaned and re-installed, or simply replaced with a new tensioned band. When the pneumatic cylinder 502 of the entry tension assembly 500 is re-energized, the newly-installed tensioned band will revert to having the same tension value as before.

Accordingly, band tensioning can be enabled by pneumatic cylinders (which provide tension while in the "on" state and no tension while in the "off" state), proximity switches disposed along the pivot gear (which indicate whether the tensioned band is "on" and under tension), and reed switches disposed along the pneumatic cylinder (which indicate whether the pneumatic cylinder is retracted and thus not under tension). Vertical movement and horizontal movement, meanwhile, may be enabled by position sensors (e.g., linear encoders) and motors (e.g., stepper motors).

The tensioned band of each EHD system is generally arranged so that the tensioned band contacts the surface of the substrate along an outer edge that is parallel to the media feed direction (i.e., no tensioned bands along the lead edge and the tail edge that are orthogonal to the media feed direction). For example, a printer assembly configured for one-up printing may include two EHD systems (and thus two tensioned bands), while a printer assembly configured for two-up printing may include four EHD systems (i.e., a separate set of tensioned bands for each of two substrates that have been placed on the transport belt).

Note that other configurations of tensioned bands are also possible, though such configurations often require that the user have an understanding of the spacing of the image(s) that are to be printed on the substrate. Tensioned bands cannot be positioned where an image is to be printed because the tensioned band prevents ink ejected from a print head from reaching the substrate. However, a tensioned band may extend down the middle of the substrate if images are only to be printed along the top and/or bottom edges.

One main purpose of the tensioned bands is to avoid damage to an expensive print head due to defects in the substrate, such as a curl that may displace a nozzle. Consequently, entry tension assemblies may be disposed at the very entrance of the print section while exit tension assemblies may be disposed at the very end of the print section.

Such an arrangement ensures that the substrate is always under tensioned bands while ink is being deposited by the print head(s).

Figure 6A:
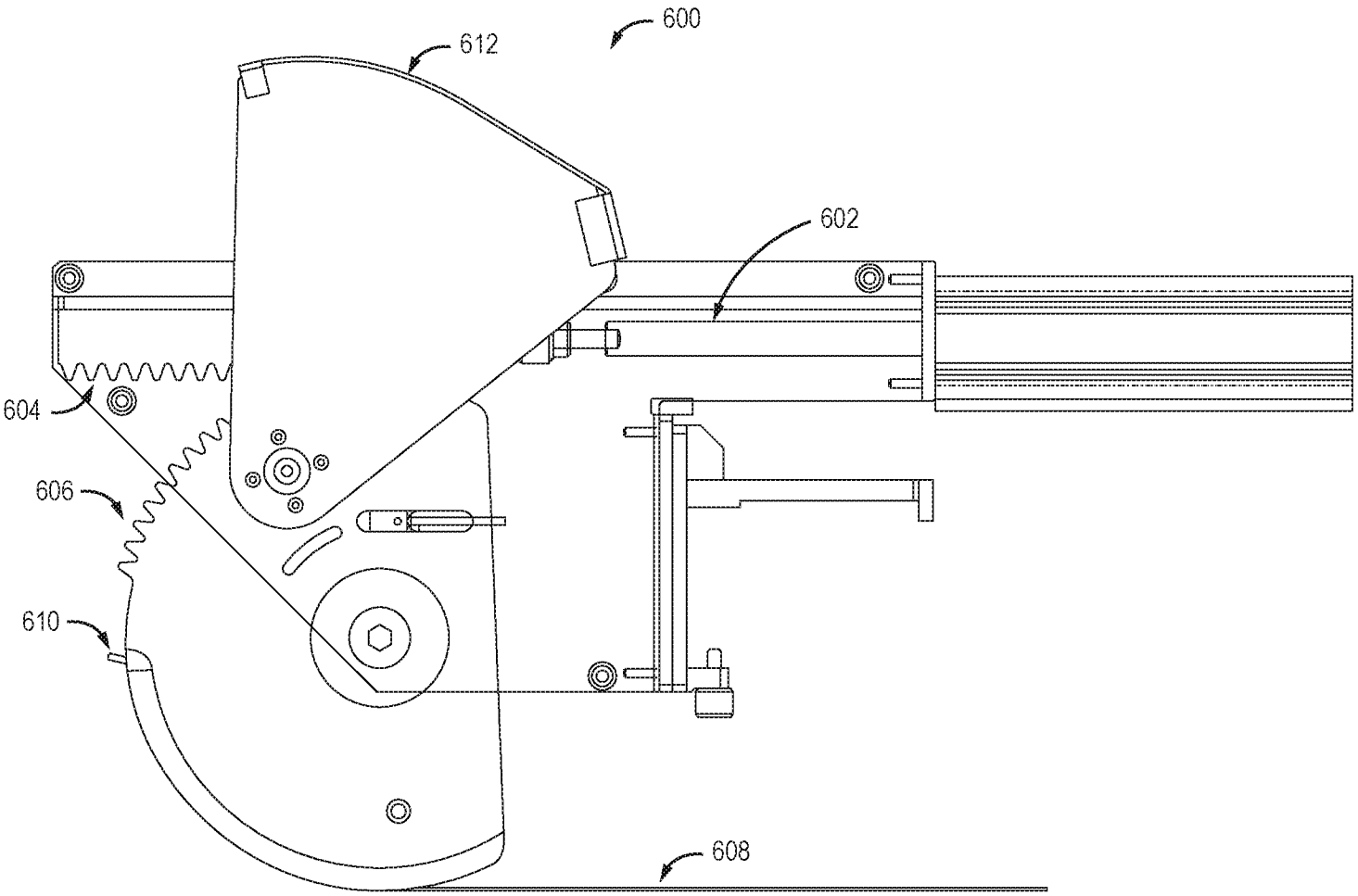
FIG. 6A includes a side view of an entry tension assembly that includes a pneumatic cylinder at max stroke position, a rack, and a pivot gear that engages the rack.

FIG. 6A includes a side view of an entry tension assembly 600 that includes a pneumatic cylinder 602 at max stroke position, a rack 604, and a pivot gear 606 that engages the rack 604. As noted above, one end of a tensioned band 608 is connected to the pivot gear 606. Linear motion of the rack 604 effected by the pneumatic cylinder 602 causes rotational motion of the pivot gear 606, thereby increasing or decreasing the tension level of the tensioned band 608.

As shown in FIG. 6A, in some embodiments the entry tension assembly 600 includes a guard 612 that protects the teeth of the pivot gear 606 from being readily contaminated, such as by dirt, dust, grease, and/or other materials. The guard 612 may be pivotably connected to a housing within which the pneumatic cylinder 602, rack 604, and/or pivot gear 606 reside. In some embodiments, the first end of the tensioned band 608 is connected to a pin 610 that is disposed along an outer surface of the pivot gear 606.

A sensor (e.g., a proximity sensor) may also be disposed within the housing that detects the tension level of the tensioned band 608. For example, an inductive proximity sensor may be configured to detect the tension level of a tensioned band that is at least partially comprised of metal, and then indicate whether the tension level meets a specified threshold.

Figure 6B:
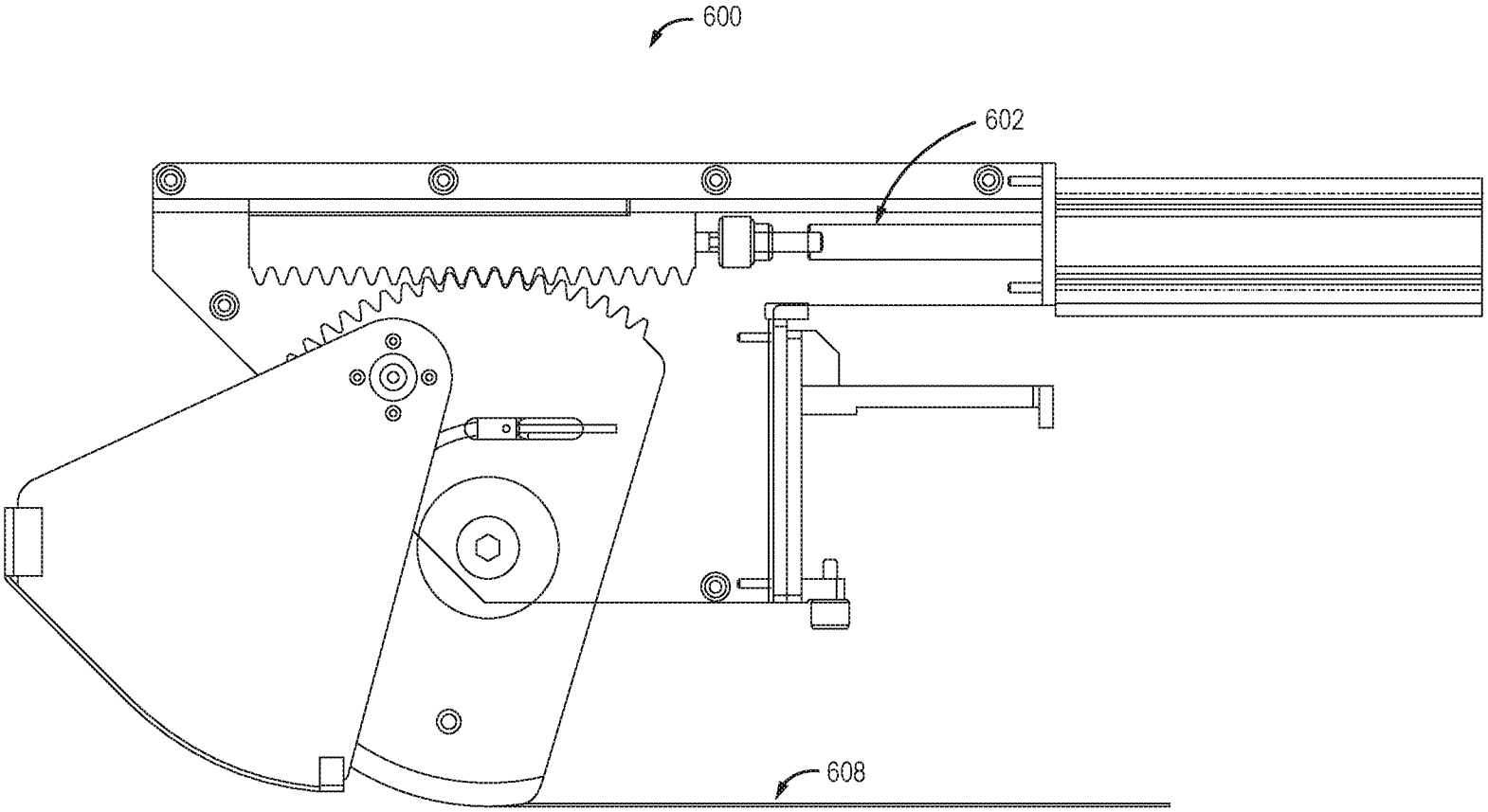
FIG. 6B depicts how as the pneumatic cylinder is actuated, a rod may retract until a specified pressure is achieved, thereby tensioning the tensioned band.

FIG. 6B depicts how as the pneumatic cylinder 602 is actuated, a rod may retract until a specified pressure is achieved, thereby tensioning the tensioned band 608. For example, in some embodiments the pneumatic cylinder 602 may enable a tensioning stroke of up to 45 mm. Together with the rod, the pneumatic cylinder 602 can automatically compensate for thermal expansion of the tensioned band 608 by maintaining a specified cylinder pressure.

Figure 6C:
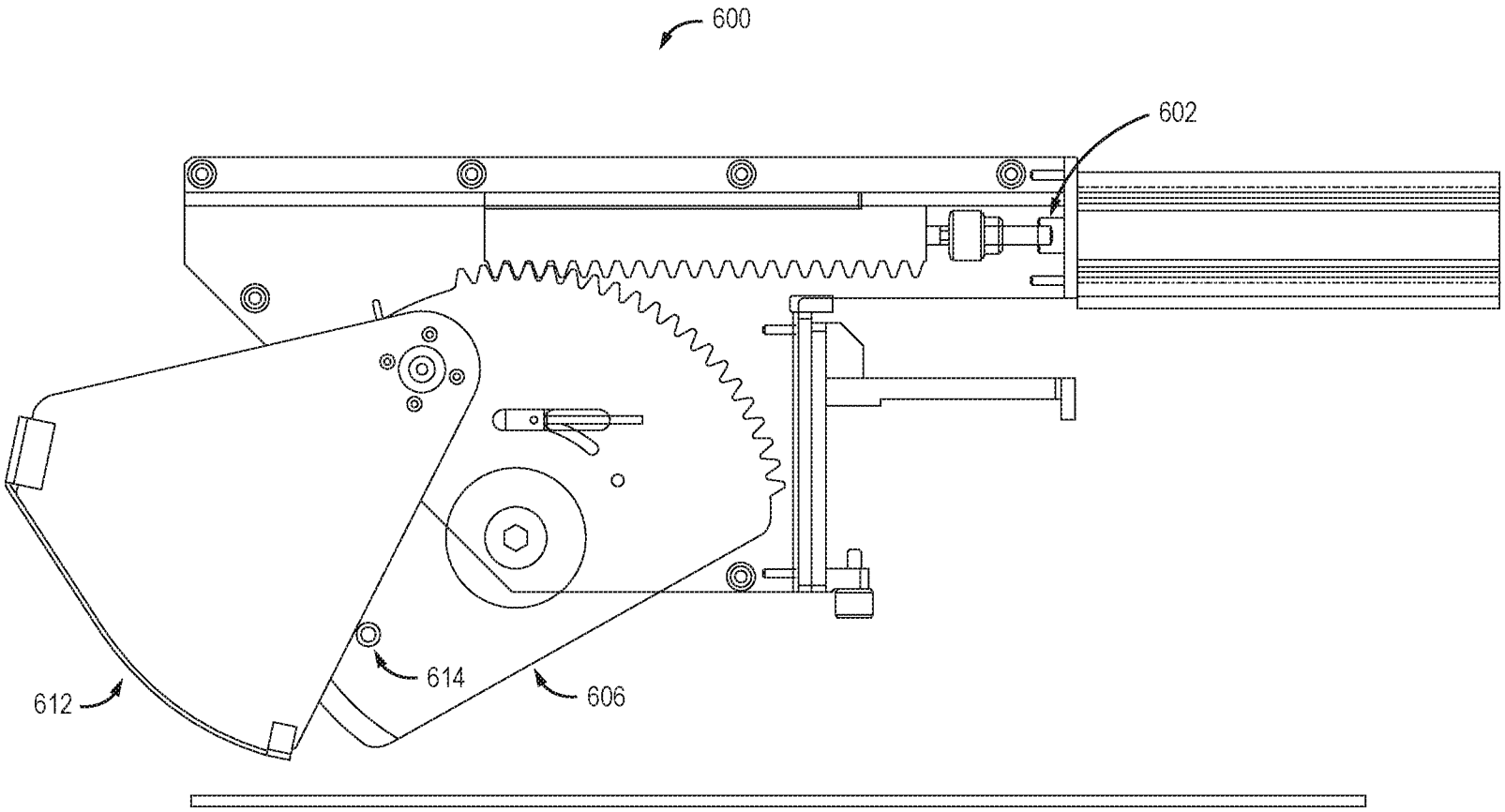
FIG. 6C depicts how as the pneumatic cylinder strokes to the minimum position, the pivot gear rotates upward, thereby creating clearance from the substrate.

FIG. 6C depicts how as the pneumatic cylinder 602 strokes to the minimum position, the pivot gear 606 rotates upward, thereby creating clearance from the substrate. Moreover, in some embodiments, a pin 614 disposed along a side wall of the pivot gear 606 may cause the guard 612 to rotate upward as well. That is, the pin 614 may cause the guard 612 to rotate upward as the pivot gear 606 rotates past a specified position. One skilled in the art will recognize that other structural features could also be used instead of, or in addition to, the pin 614.

Figure 7:
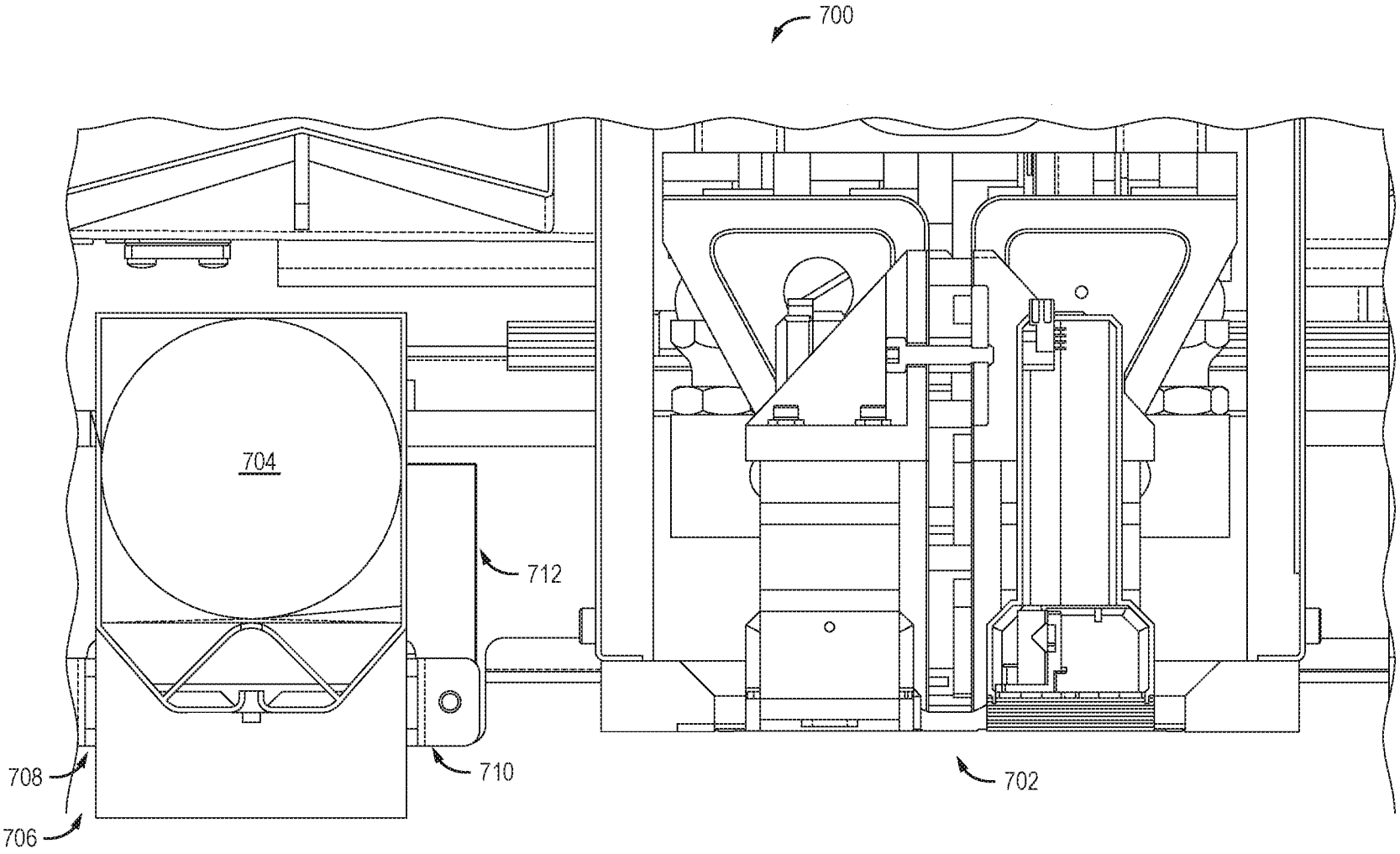
FIG. 7 includes a side view of a printer assembly that includes a print head and a vacuum hopper disposed above transfer belt.

FIG. 7 includes a side view of a printer assembly 700 that includes a print head 702 and a vacuum hopper 704 disposed above transfer belt. A substrate 706 is disposed on the transfer belt and experiences pressure applied by a tensioned band 708 that runs along at least a portion of the printer assembly 700. The print head 702 is responsible for ejecting ink onto the substrate 706 (e.g., to form an image) as the transfer belt transfers the substrate 706 beneath the print head 702.

In some embodiments, a magnet bracket 712 is connected to the vacuum hopper 704 and a magnet 710 is disposed at the lower end of the magnet bracket 712. The magnet 710 and/or the magnet bracket 712 can run across the entire cross process length of the printer assembly 700. Such an assembly may be attached to some or all of the vacuum hoppers in the printer assembly 700. Together, the magnet 710 and the magnet bracket 712 may be referred to as a "band support assembly." One benefit effected by the band support assembly is limiting deflection of the tensioned band within the print areas. Another benefit is that the band support assembly (and, more specifically, the magnet 710) can consistently and reliably space the tensioned band 708 off the print head 702 by a specified amount.

Figure 8:
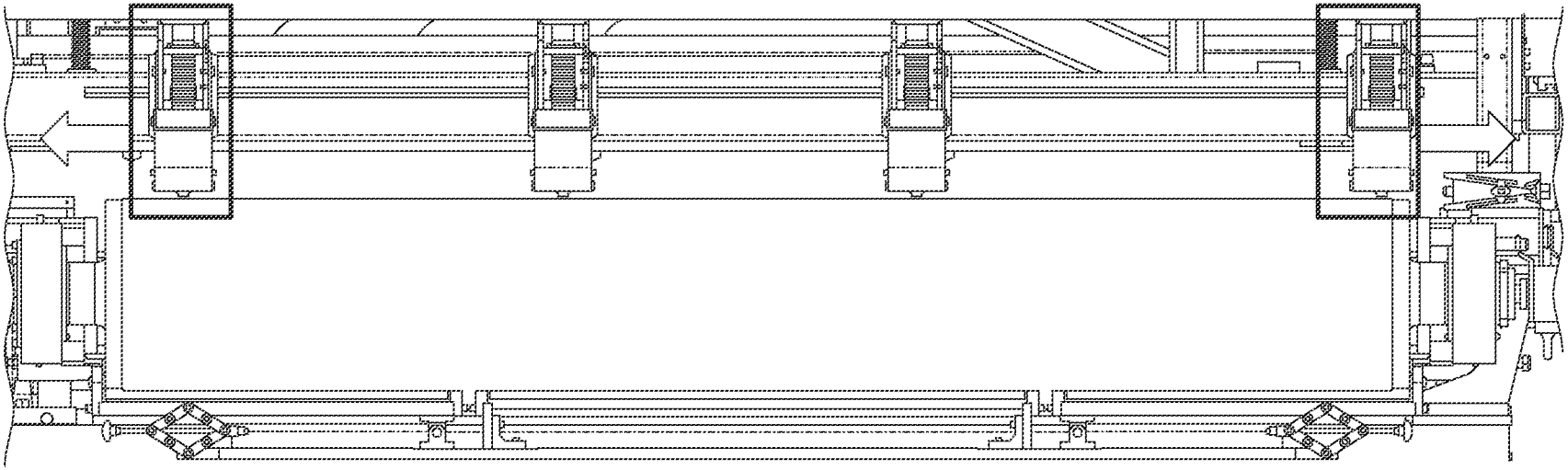
FIG. 8 illustrates how some or all of the tensioned bands within a printer assembly can be automatically moved off the transfer belt when not in use.

FIG. 8 illustrates how some or all of the tensioned bands within a printer assembly can be automatically moved off the transfer belt when not in use. This eliminates the need to manually remove unused tensioned bands on a per-job basis. However, such embodiments introduce several additional concerns that are not relevant to other embodiments:

- Cross-print direction motion must be enabled for some or all of the EHD systems;
- Moveable entry and exit tension assemblies have an increased footprint within the printer assembly (particularly in the cross-print direction);
- The gap between the transfer belt and the lower frame may need to be filled to help support unused tensioned bands (i.e., to prevent sag); and
- Additional components (e.g., sensors) may be necessary to determine sag across the entire length of each tensioned band (i.e., because too much sag would cause the tensioned band to snag on the transfer belt as it transitions from a docking position back onto the transfer belt).

Figure 9:
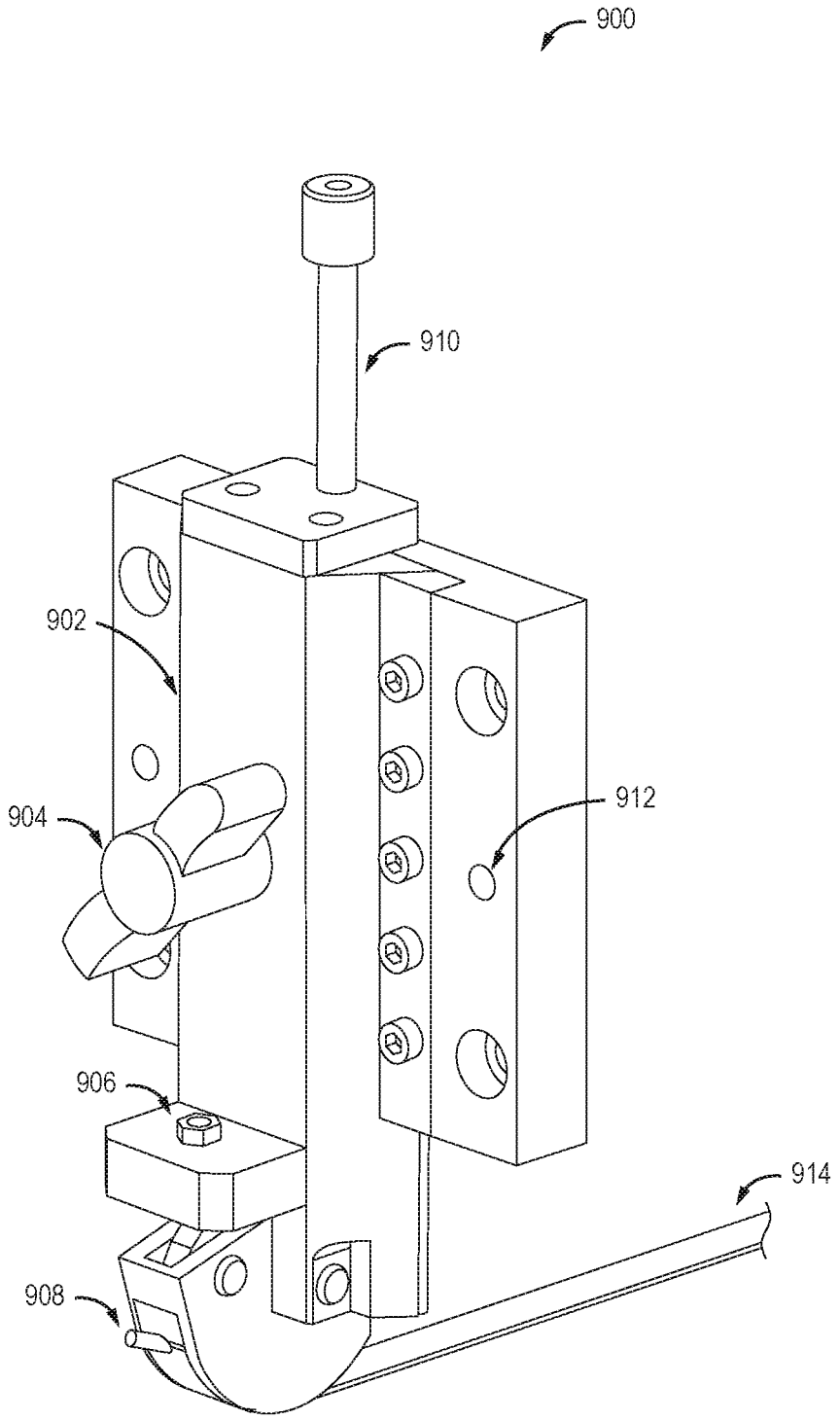
FIG. 9 depicts another embodiment of an entry tension assembly that can be fixedly attached to a rigid feature of a printer assembly (e.g., a bar or support beam that extends across a transfer belt and/or a bed of the printer assembly).

FIG. 9 depicts another embodiment of an entry tension assembly 900 that can be fixedly attached to a rigid feature of a printer assembly (e.g., a bar or support beam that extends across a transfer belt and/or a bed of the printer assembly). More specifically, FIG. 9 depicts a manual design that allows tensioned bands to be moved by a user based on the width of the substrate that is to be printed on.

The entry tension assembly 900 can include a mounting block 902 connected to a vertical adjustment screw 910 that engages the rigid feature of the printer assembly. The mounting block 902 may be, for example, a dovetail rail. The vertical adjustment screw 910 includes a first segment that is installed within the rigid feature of the printer assembly and a second segment that threadably engages the mounting block 902.

A band tensioner 908 (also referred to as a "tensioner") may be mounted to a lower end of the mounting block 902. One end of a tensioned band 914 is connected to the tensioner 908, while another end of the tensioned band 914 is connected to an exit tension assembly disposed downstream of the entry tension assembly 900 in the media feed direction. The exit tension assembly may include some or all of the same components as the entry tension assembly. The tensioned band 914 holds a substrate substantially flat against a transport belt of the printer assembly during printing by applying pressure to a surface of the substrate. The tension level of the tensioned band 914 may be manually modified by turning a band tensioning nut 906.

In some embodiments, a vertical lock 904 disposed along an outer surface of the mounting block 902 engages the second segment of the vertical adjustment screw 910. Accordingly, the vertical position of the entry assembly 900 (and thus the tensioned band 914) could be manually adjusted by turning the vertical lock 904, which causes rotation of the vertical adjustment screw 910 and vertical movement of the mounting block 902 and the tensioner 908 to which the tensioned band 914 is connected. Vertical position of the tensioned band 914 may be adjustable from 1 mm to 50 mm above the transfer belt (e.g., a vacuum belt). One or more dowel pins 912 could also be used to ensure the entry tension assembly 900 remained aligned with an extrusion track of the printer assembly.

Figure 10A:
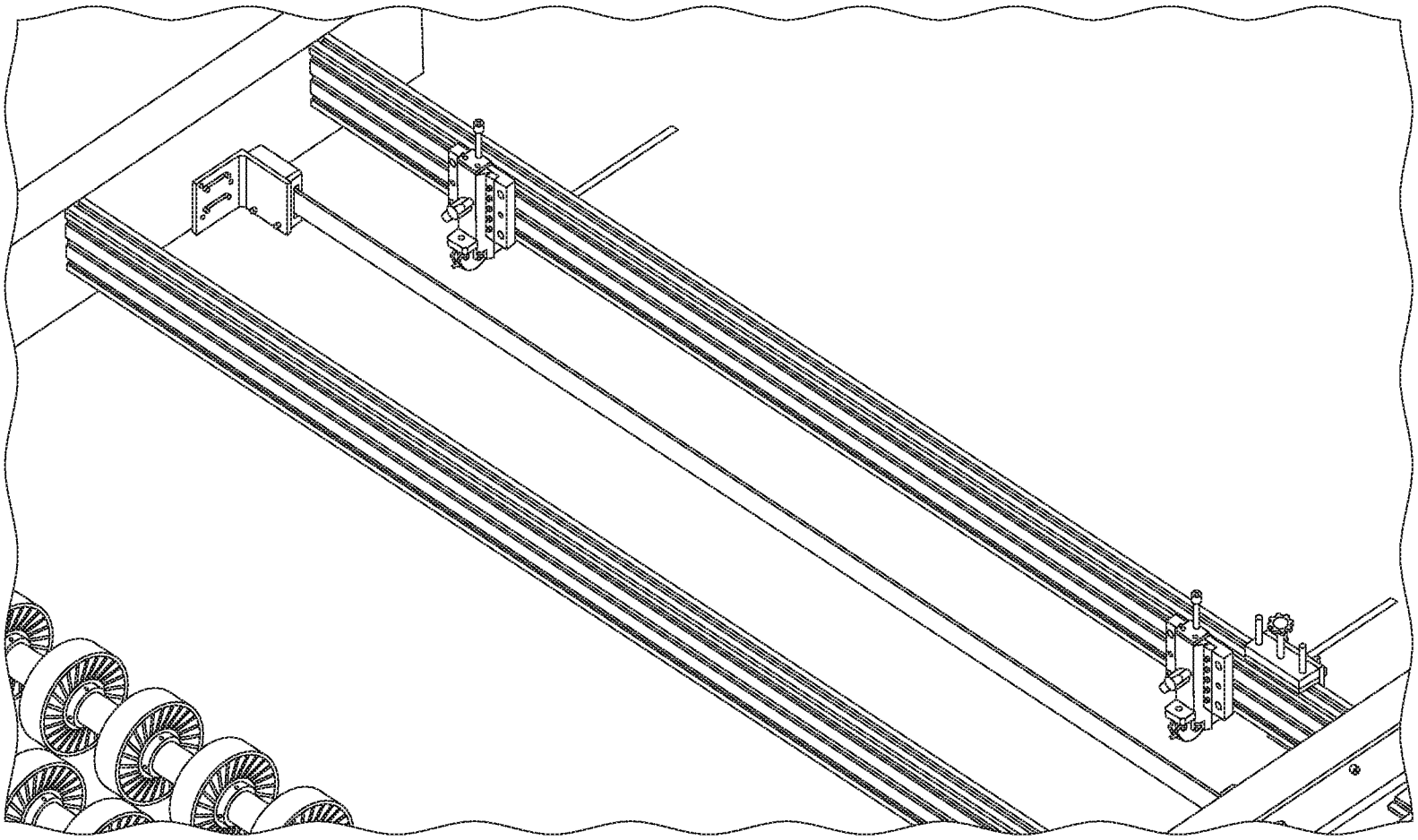
FIG. 10A shows multiple entry tension assemblies connected to an existing extrusion of a printer assembly.
Figure 10B:
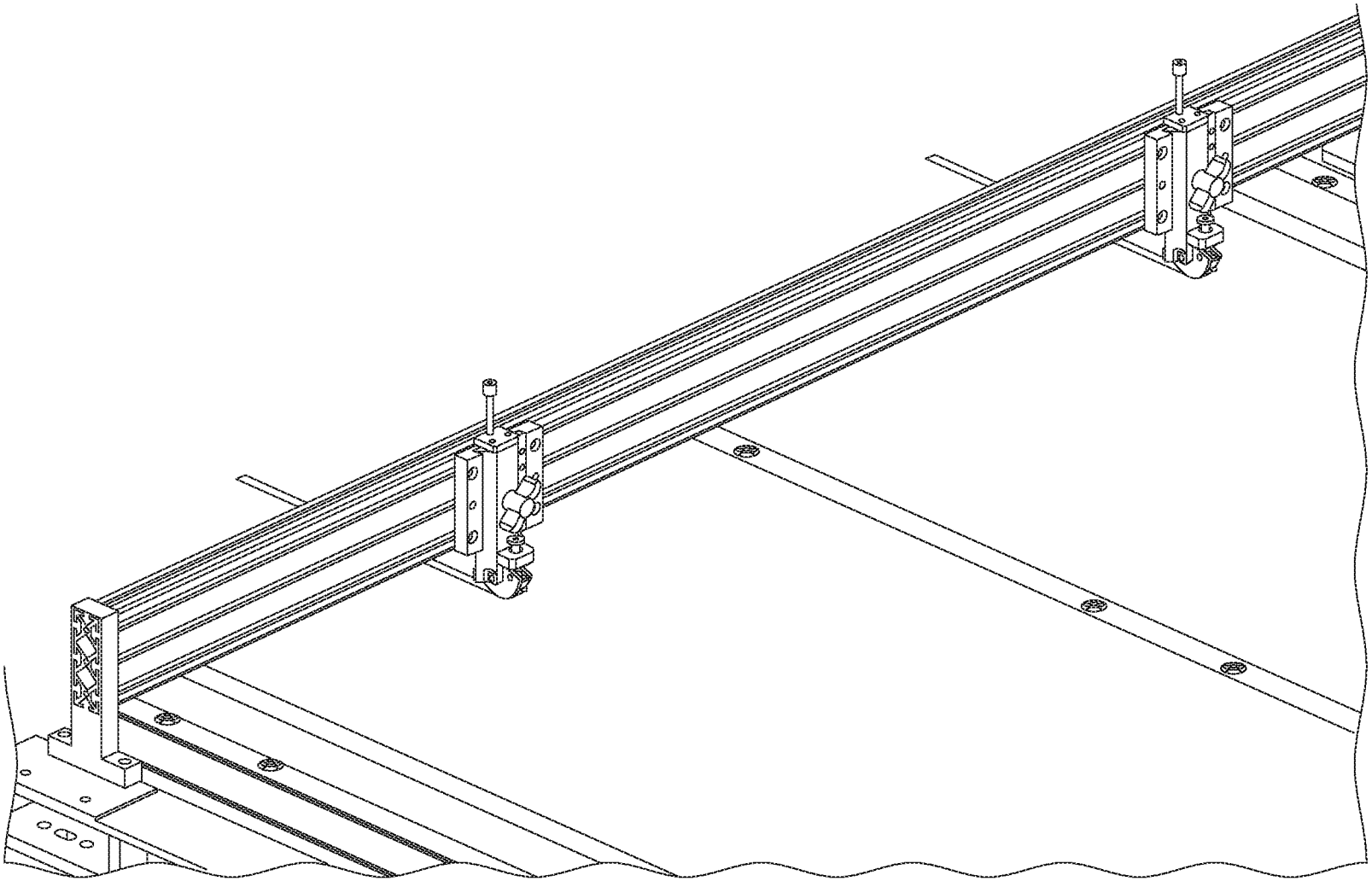
FIG. 10B shows multiple exit tension assemblies connected to another existing extrusion of the printer assembly.

FIG. 10A shows multiple entry tension assemblies connected to an existing extrusion of a printer assembly, while FIG. 10B shows multiple exit tension assemblies connected to another existing extrusion of the printer assembly. Here, for example, the entry tension assemblies and the exit tension assemblies are connected to separate frames of the printer assembly.

Some or all of the entry tension assemblies and exit tension assemblies within a printer assembly may be moveable orthogonal to the media feed direction. For example, an outermost entry assembly may be moveable along the existing extrusion. Horizontal adjustment of the entry tension assemblies and/or the exit tension assemblies can be performed manually by a user or automatically by the printer assembly (e.g., upon receiving input indicative of the width of the substrate to be printed on). Such input could be provided via a user interface that is presented by the printer assembly or an electronic device (e.g., mobile phone, tablet, or laptop) that is communicatively coupled to the printer assembly.

Figure 11:
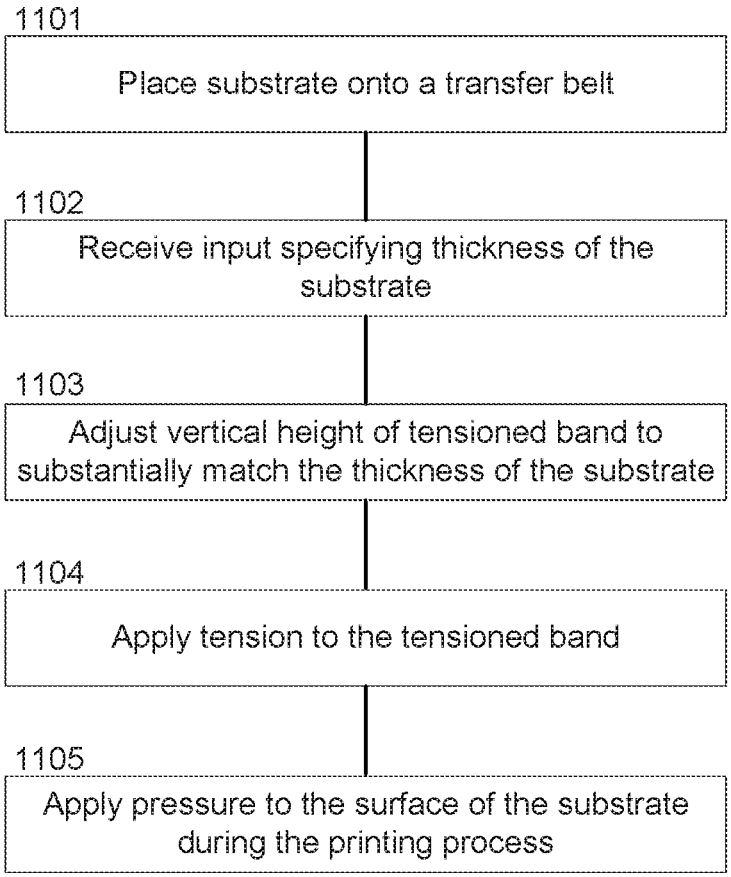
FIG. 11 depicts a process for ensuring high print quality by holding a substrate substantially flat against a transfer belt of a printer during printing.

FIG. 11 depicts a process 1100 for ensuring high print quality by holding a substrate substantially flat against a transfer belt of a printer during printing. More specifically, one or more tensioned bands can apply pressure to a surface of the substrate, thereby ensuring that the substrate remains substantially flat during printing.

A user initially places a substrate onto a transfer belt of a printer (step 1101). The transfer belt may be, for example, a vacuum belt that allows the printer to print on warped, uneven, or heavy media. However, as noted above, printing quality may suffer if the substrate includes any defects. For example, if the substrate includes a curl at the edge of the substrate, the vacuum belt may be unable to suck the substrate down flat due to its rigidity (i.e., the vacuum(s) may suffer too much leakage).

Accordingly, an entry tension assembly (e.g., entry tension assembly 500 of FIG. 5) may receive input specifying a thickness of the substrate (step 1102). The entry tension assembly may include a pneumatic cylinder connected to a rack, a pivot gear that engages the rack, and a tensioned band having a first end connected to the pivot gear and a second end connected to an exit tension assembly disposed downstream in the media feed direction.

The input could be provided by a user via an interface that is displayed by the printer or an electronic device (e.g., a mobile phone, tablet, or laptop) that is communicatively coupled to the printer. For example, the user may specify a substrate type or a known thickness value. Alternatively, the input could be provided by a sensor that is disposed upstream of the entry tension assembly in the media feed direction. The sensor may be configured to automatically determine the thickness of the substrate upon detecting the substrate is a specified distance away from the entry tension assembly, a print head, or some other structural printer feature (e.g., a set of crush rollers).

The vertical height of the tensioned band is then adjusted to substantially match the thickness of the substrate (step 1103). For example, such adjustments may be performed automatically by one or more motors that are communicatively coupled to the entry tension assembly. The motor(s) may enable bi-directional adjustment of the vertical position of the tensioned band. As another example, such adjustments may be performed manually by a user (e.g., by turning a vertical lock or setting one or more vertical adjustment screws).

The entry tension assembly can then apply tension to the tensioned band (step 1104), for example, by actuating the pneumatic cylinder. Linear motion of the rack effected by the pneumatic cylinder causes rotational motion of the pivot gear, thereby increasing or decreasing the tension level of the tensioned band. After being placed under sufficient tension, the tensioned band holds the substrate substantially flat against the transfer belt during printing by applying pressure to the surface of the substrate (step 1105). The tensioned band generally contacts the surface of the substrate substantially proximate to an outer edge of the substrate that is parallel to the media feed direction. The entry tension assembly may be one of multiple entry tension assemblies (each with a corresponding exit tension assembly and tensioned band) that are disposed above the substrate.

Unless contrary to physical possibility, it is envisioned that the steps described above may be performed in various sequences and combinations. Other steps could also be included in some embodiments. For example, each entry tension assembly and/or each exit tension assembly could be adjusted along the x-axis (i.e., horizontally orthogonal to the media feed direction), y-axis (i.e., vertically orthogonal to the media feed direction), and/or z-axis (i.e., longitudinally parallel to the media feed direction). As another example, some or all of the entry tension assemblies and/or exit tension assemblies may be moved into an operational position before printing, and then moved into a non-operational positional after printing.

Processing System

Figure 12:
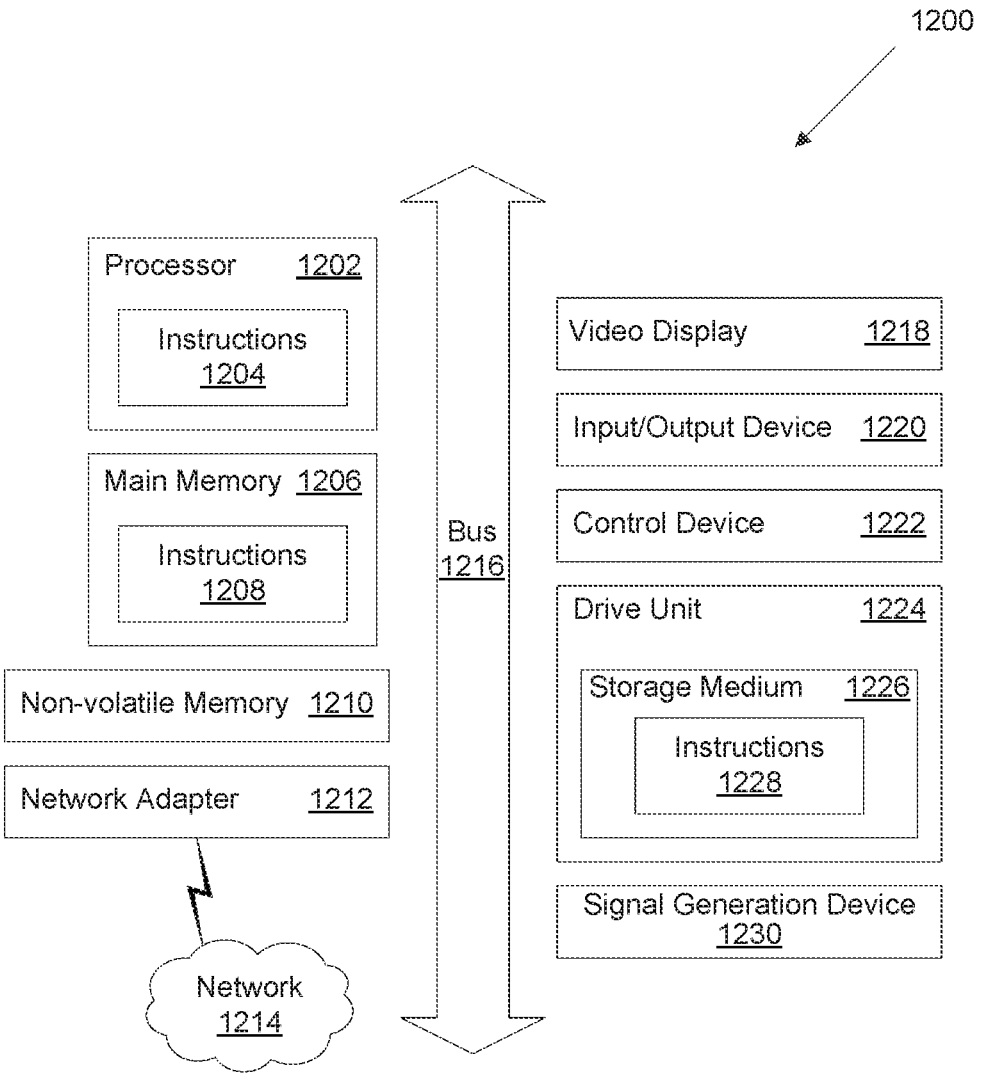
FIG. 12 is a block diagram illustrating an example of a processing system in which at least some operations described herein can be implemented.

FIG. 12 is a block diagram illustrating an example of a processing system 1200 in which at least some operations described herein can be implemented. The computing system may include one or more central processing units ("processors") 1202, main memory 1206, non-volatile memory 1210, network adapter 1212 (e.g., network interfaces), video display 1218, input/output devices 1220, control device 1222 (e.g., keyboard and pointing devices), drive unit 1224 including a storage medium 1226, and signal generation device 1230 that are communicatively connected to a bus 1216. The bus 1216 is illustrated as an abstraction that represents any one or more separate physical buses, point to point connections, or both connected by appropriate bridges, adapters, or controllers. The bus 816, therefore, can include, for example, a system bus, a Peripheral Component Interconnect (PCI) bus or PCI-Express bus, a HyperTransport or industry standard architecture (ISA) bus, a small computer system interface (SCSI) bus, a universal serial bus (USB), IIC (I2C) bus, or an Institute of Electrical and Electronics Engineers (IEEE) standard 1394 bus, also called "Firewire."

In various embodiments, the processing system 1200 operates as part of a printer assembly, although the processing system 1200 may be connected (e.g., wired or wirelessly) to the printer assembly. In a networked deployment, the processing system 1200 may operate in the capacity of a server or a client machine in a client-server network environment, or as a peer machine in a peer-to-peer (or distributed) network environment.

The processing system 1200 may be a server computer, a client computer, a personal computer (PC), a tablet PC, a laptop computer, a personal digital assistant (PDA), a mobile telephone, an iPhone®, an iPad®, a Blackberry®, a processor, a telephone, a web appliance, a network router, switch or bridge, a console, a hand-held console, a gaming device, a music player, or any portable, device or any machine capable of executing a set of instructions (sequential or otherwise) that specify actions to be taken by the processing system.

While the main memory 1206, non-volatile memory 1210, and storage medium 1226 (also called a "machine-readable medium) are shown to be a single medium, the term "machine-readable medium" and "storage medium" should be taken to include a single medium or multiple media (e.g., a centralized or distributed database, and/or associated caches and servers) that store one or more sets of instructions 1228. The term "machine-readable medium" and "storage medium" shall also be taken to include any medium that is capable of storing, encoding, or carrying a set of instructions for execution by the computing system and that cause the computing system to perform any one or more of the methodologies of the presently disclosed embodiments.

In general, the routines executed to implement the embodiments of the disclosure, may be implemented as part of an operating system or a specific application, component, program, object, module or sequence of instructions referred to as "computer programs." The computer programs typically comprise one or more instructions (e.g., instructions 1204, 1208, 1228) set at various times in various memory and storage devices in a computer, and that, when read and executed by one or more processing units or processors 1202, cause the processing system 1200 to perform operations to execute elements involving the various aspects of the disclosure.

Moreover, while embodiments have been described in the context of fully functioning computers and computer systems, those skilled in the art will appreciate that the various embodiments are capable of being distributed as a program product in a variety of forms, and that the disclosure applies equally regardless of the particular type of machine or computer-readable media used to actually effect the distribution.

Further examples of machine-readable storage media, machine-readable media, or computer-readable (storage) media include, but are not limited to, recordable type media such as volatile and non-volatile memory devices 1210, floppy and other removable disks, hard disk drives, optical disks (e.g., Compact Disk Read-Only Memory (CD ROMS), Digital Versatile Disks (DVDs)), and transmission type media, such as digital and analog communication links.

The network adapter 1212 enables the processing system 1200 to mediate data in a network 1214 with an entity that is external to the processing system 1200 through any known and/or convenient communications protocol supported by the processing system 1200 and the external entity. The network adapter 1212 can include one or more of a network adaptor card, a wireless network interface card, a router, an access point, a wireless router, a switch, a multilayer switch, a protocol converter, a gateway, a bridge, bridge router, a hub, a digital media receiver, and/or a repeater.

The network adapter 1212 can include a firewall which can, in some embodiments, govern and/or manage permission to access/proxy data in a computer network, and track varying levels of trust between different machines and/or applications. The firewall can be any number of modules having any combination of hardware and/or software components able to enforce a predetermined set of access rights between a particular set of machines and applications, machines and machines, and/or applications and applications, for example, to regulate the flow of traffic and resource sharing between these varying entities. The firewall may additionally manage and/or have access to an access control list which details permissions including for example, the access and operation rights of an object by an individual, a machine, and/or an application, and the circumstances under which the permission rights stand.

The techniques introduced here implemented by, for example, programmable circuitry (e.g., one or more microprocessors), programmed with software and/or firmware, entirely in special-purpose hardwired (i.e., non-programmable) circuitry, or in a combination or such forms. Special-purpose circuitry can be in the form of, for example, one or more application-specific integrated circuits (ASICs), programmable logic devices (PLDs), field-programmable gate arrays (FPGAs), etc.

Remarks

The above description of various embodiments has been provided for the purposes of illustration and description. It is not intended to be exhaustive or to limit the claimed subject matter to the precise forms disclosed. Many modifications and variations will be apparent to one skilled in the art. One skilled in the relevant technology will also understand that some of the embodiments may include other features that are not described in detail herein. Some well-known structures or functions may not be shown or described in detail below, to avoid unnecessarily obscuring the relevant descriptions of the various examples.

Although the above Detailed Description describes certain embodiments and the best mode contemplated, no matter how detailed the above appears in text, the embodiments can be practiced in many ways. Details of the systems and methods may vary considerably in their implementation details, while still being encompassed by the specification. As noted above, particular terminology used when describing certain features or aspects of various embodiments should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless those terms are explicitly defined herein. Accordingly, the actual scope of the invention encompasses not only the disclosed embodiments, but also all equivalent ways of practicing or implementing the embodiments under the claims.

The language used in the specification has been principally selected for readability and instructional purposes, and it may not have been selected to delineate or circumscribe the inventive subject matter. It is therefore intended that the scope of the invention be limited not by this Detailed Description, but rather by any claims that issue on an application based hereon. Accordingly, the disclosure of various embodiments is intended to be illustrative, but not limiting, of the scope of the embodiments, which is set forth in the following claims.

The invention claimed is:

1. A tension assembly comprising:

a mounting block;

a vertical adjustment screw having a first segment that is anchored within a rigid feature of a printer and a second segment that is installed within the mounting block;

a vertical lock disposed along an outer surface of the mounting block, wherein the vertical lock engages the second segment of the vertical adjustment screw, and wherein vertical movement of the tension assembly is enabled through rotation of the vertical lock;

a tensioner mounted to the mounting block; and a tensioned band having a first end that is connected to the tensioner and a second end that is connected to another tension assembly disposed downstream of the tension assembly in a media feed direction, wherein the tensioned band holds a substrate substantially flat against a transfer belt of the printer during printing by applying pressure to a surface of the substrate.

2. The tension assembly of claim 1, wherein rotation of the vertical lock causes rotation of the vertical adjustment screw and vertical movement of the mounting block and the tensioner to which the tensioned band is connected.

3. The tension assembly of claim 1, wherein the rigid feature of the printer is a bar or a support beam that extends across a bed of the printer.

4. The tension assembly of claim 1, wherein the tensioned band contacts the surface of the substrate substantially proximate to an outer edge parallel to the media feed direction.

5. The tension assembly of claim 1, wherein the transfer belt is a vacuum belt.

6. The tension assembly of claim 1, further comprising:

a band tensioning nut that, when rotated, causes tension of the tensioned band to be altered.

7. A system comprising:

an entry tension assembly that is connected to a first structural feature of a printer, wherein the entry tension assembly includes:

a mounting block, a vertical adjustment screw having a first segment that is anchored within the first structural feature of the printer and a second segment that threadably engages the mounting block, and a lock accessible along an outer surface of the mounting block, wherein the lock engages the second segment of the vertical adjustment screw in such a manner that vertical movement of the entry tension assembly is enabled through rotation of the lock;

an exit tension assembly that is connected to a second structural feature of the printer, wherein the exit tension assembly is disposed downstream of the entry tension assembly in a media feed direction; and a tensioned band having a first end that is connected to the entry tension assembly and a second end that is connected to the exit tension assembly, wherein the tensioned band holds a substrate substantially flat against a transfer belt of the printer by applying pressure to a surface of the substrate.

8. The system of claim 7, wherein the exit tension assembly includes:

a mounting block, a vertical adjustment screw having a first segment that is anchored within the second structural feature of the printer and a second segment that threadably engages the mounting block, and a lock accessible along an outer surface of the mounting block, wherein the lock engages the second segment of the vertical adjustment screw in such a manner that vertical movement of the exit tension assembly is enabled through rotation of the lock.

9. The system of claim 8, wherein vertical position of the entry tension assembly is adjustable independent of vertical position of the exit tension assembly.

10. The system of claim 7, wherein the entry tension assembly further includes:

a tensioner to which the first end of the tensioned band is connected.

11. The system of claim 10, wherein the entry tension assembly further includes:

a band tensioning nut that, when rotated, causes tension of the tensioned band to be altered.

12. The system of claim 10, wherein vertical position of the tensioned band is adjustable from 1 millimeter (mm) to 50 mm above the transfer belt.

13. The system of claim 10, wherein the entry and exit tension assemblies are arranged such that the tensioned band contacts the surface of the substrate proximate to an outer edge that is parallel to the media feed direction.

* * * * *